United States Patent [19]

Miniere

[11] 4,170,989

[45] Oct. 16, 1979

[54] MASSAGING APPARATUS

[75] Inventor: Jack K. Miniere, Winter Park, Fla.

[73] Assignee: Herbert Geartner, Orlando, Fla.

[21] Appl. No.: 853,022

[22] Filed: Nov. 21, 1977

[51] Int. Cl.[2] ..... A61H 7/00

[52] U.S. Cl. ..... 128/52

[58] Field of Search ..... 128/57, 52, 51, 44, 128/33, 56

[56] References Cited

U.S. PATENT DOCUMENTS

| | | | |
|---|---|---|---|
| 2,127,132 | 8/1938 | Monroe | 128/57 |
| 2,672,860 | 3/1954 | Badger et al. | 128/33 |
| 2,773,498 | 12/1956 | Himmelman | 128/33 |
| 3,196,868 | 7/1965 | Johnston | 128/57 |
| 3,298,363 | 1/1967 | Parkin | 128/33 |
| 3,628,528 | 12/1971 | Roberts | 128/57 |

*Primary Examiner*—Lawrence W. Trapp

*Attorney, Agent, or Firm*—Duckworth, Hobby, Allen & Pettis

[57] ABSTRACT

An apparatus to massage a person's back which may be incorporated into a chair, or the like, and having a frame having a plurality of movable slats mounted transversely thereon and having a cover thereover. An electric motor is mounted to the frame and is operatively connected to an elongated cam rotably supported on the frame for rotation by the electric motor. The elongated cam is mounted adjacent to said plurality of slats and forms a helix on a shaft connected to the electric motor so that rotation of the elongated cam will raise and lower individual slats responsive to the cam pushing thereagainst.

11 Claims, 3 Drawing Figures

MASSAGING APPARATUS

BACKGROUND OF THE INVENTION

The present invention relates to massaging devices and especially to massaging chairs adapted to give a continuous rubbing or rolling motion to the back or other portion of the user's body.

In the past, a great variety of massaging devices have been provided, including hand and individual massages, but the massaging devices most closely associated with the present invention are massaging and therapeutic chairs and tables. A typical massaging chair might include a vibratory mechanism having a plurality of wheels chain mounted to run up and down a track located behind the front cushioning of the chair back as illustrated in U.S. Pat. No. 3,322,116 for a vibratory massage apparatus. Another type of therapeutic chair uses transducers to generate vibratory frequencies in the frame of the chair as illustrated in U.S. Pat. No. 3,556,088. U.S. Pat. No. 2,790,440, a variable pressure cushion is shown having a plurality of slats interconnected with hinges and mounted to a framework which is connected to electric motors driving worm gears to move the slats. More typical is U.S. Pat. No. 3,628,528, for a massaging and reducing machine which has a roller riding on a track and driven by an electric motor riding under a belt which moves the belt as the roller moves by. In U.S. Pat. No. 3,298,363, an apparatus with an adjustable body support member is provided, while in the Portumus massaging apparatus of U.S. Pat. No. 2,827,044, an electric motor drives a rotating cylindrical shaft having a cam groove therein found in a double helix with a cam follower following the groove back and forth, similar to the operation of a line guide on a fishing reel. U.S. Pat. No. 3,656,190 illustrates a body support having a cover and a plurality of spring loaded members thereunder while the massage couch of U.S. Pat. No. 3,207,152 has an electric motor driving shafts to manipulate circular pads of foam rubber protruding through the center portion of a bench or table. The massaging chair of U.S. Pat. No. 3,653,375 has electric motors with an eccentric weight mounted thereon adjacent to the frame of the chair so that actuation of the motors will produce a vibratory action in the frame and chair.

In contrast, the present invention provides a simple positive massaging action in a chair which utilizes support slats as the cam followers which are driven by an elongated helical cam formed by a steel, plastic, or aluminum bar, or the like, wrapped around an elongated shaft which is driven by an electric motor and thereby provides a continuously variable movement of the slats mounted under the cushioning cover material of the chair providing a uniform and continuous backrub.

SUMMARY OF THE INVENTION

A massaging system is mounted on a frame having an electric motor driving an elongated shaft having a helical cam thereon in a rotary fashion. A plurality of slats is movably mounted transverse to the elongated cam and adjacent thereto under cushioning and cover material whereby rotation of the elongated cam by the electric motor will raise and lower the slats responsive to the helical cam. The helical cam can be formed in a straight shaft having a bar wound in a helix around the shaft and attached thereto.

BRIEF DESCRIPTION OF THE DRAWINGS

Other objects, features, and advantages of the present invention will be apparent from the written description and the drawings, in which.

DESCRIPTION OF THE PREFERRED EMBODIMENT

Figure 1:
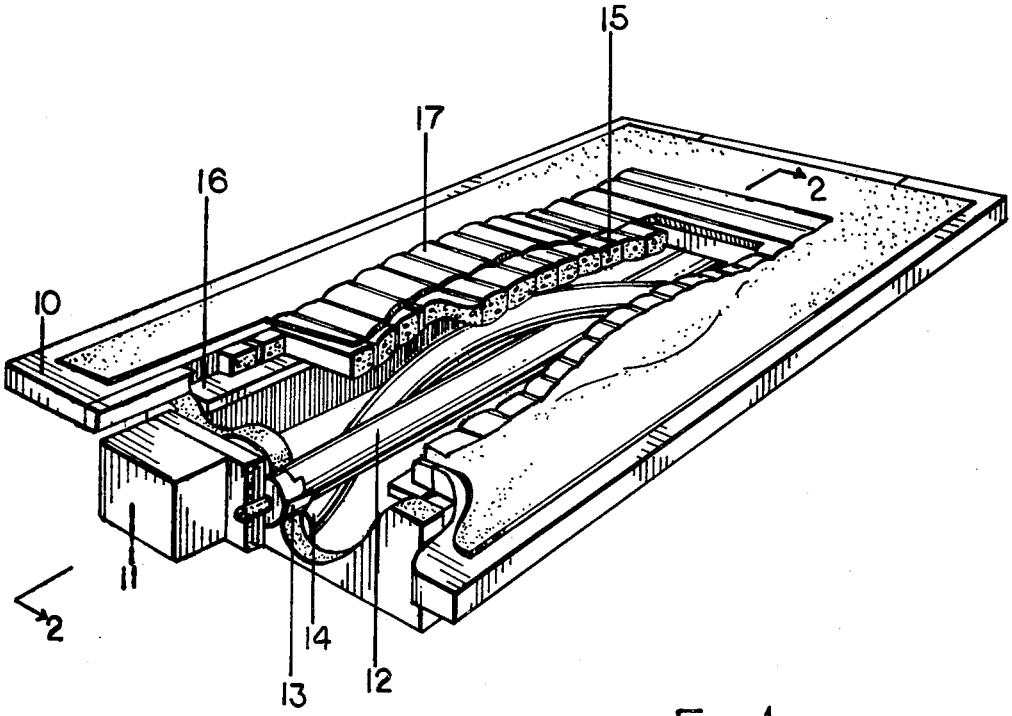
FIG. 1 is a fragmentary perspective view of a massaging apparatus in accordance with the present invention.
Figure 2:
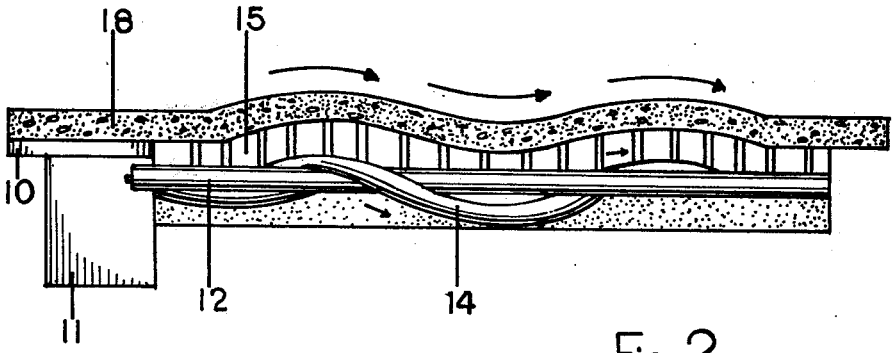
FIG. 2 is a sectional view taken on a line 22 of FIG. 1.

Referring to FIGS. 1 and 2 of the drawings, a massaging mechanism in accordance with the present invention is illustrated having a frame 10 with an electric motor and gear box 11 attached thereto and attached to an elongated shaft 12 mounted in bushings 13 to each end of the frame 10. The shaft 12 is mounted for rotation in the bushings 13 and is attached to be rotably driven by the motor 11. The elongated shaft 12 has a helix bar 14 wrapped therearound and fixedly attached thereto in a helical manner as illustrated so that rotation of the shaft 12 rotates the bar 14, thereby forming an elongated cam. The cam lobe extends from one end of the shaft 12 to the other so that the rotation of the cam helix bar 14 will continuously put a different portion of the cam facing a plurality of slats 15, which are supported by a frame ledge 16 mounted to the frame 10. Slats 15 are covered with a flexible covering material 17 and may also have cushioning material 18 mounted between the covering material 17 and the slats 15. Slats 15 can be interconnected or held flat with an elastic band, but this has been found not to be necessary in that the pressure from the user's back will tend to keep the slats pushed back against the camming bar 14 and in addition, the flexible covering 17 maintains the slats 15 taut against the camming bar 14. Rotation of the shaft 12 rotates the camming bar 14 against the slats 15 which act as their own cam follower. Slats 15 may be made of wood or of a hard plastic or other material as desired, and may be one polymer sheet with deep grooves therein. Thus, the simple rotation of the shaft 12 by the motor 11 provides a rising and falling action running up and down the length of the slats as the bar turns.

Figure 3:
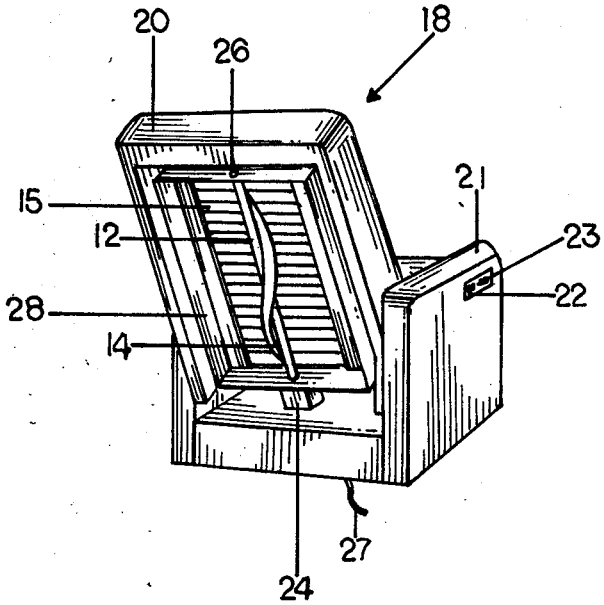
FIG. 3 is a rear perspective view of a chair having the present invention attached therein.

FIG. 3 illustrates a lounge chair 18 having a back portion 20 and a pair of arms 21. One of the arms 21 has a control panel 22 with control buttons 23 thereon, which are adapted to actuate a motor 24 mounted to a wooden frame 25 formed in the back of the chair and having the plurality of slats 15 mounted therein. The shaft 12 is illustrated mounted in a bushing 26 at the other end from the bushing 13 illustrated in FIG. 1. The motor 24 is attached to the frame 25 and has a power line 27 connected thereto through the switching panel 22, which can turn the motor on and off, and if a two speed motor is provided, the speed can be varied. The motor is geared to rotate the shaft 12 at any desired speed, such as 6 or 7 r.p.m. However, a variable speed, or reversable motor can be provided which can vary the speed over a wide range of massaging action. The geared motor 24 drives the shaft 12 which drives the helix camming bar 14 to push the slats 15 to massage an individual sitting in the chair 18. As can be seen from this view, the simplified massaging apparatus in FIGS. 1 and 2 can be easily mounted in a chair. It will of course be appreciated that the back of the chair 18 would be covered to cover or enclose the mechanism within the back of the chair.

The present invention advantageously provides an inexpensive massaging apparatus for incorporation into a chair or similar piece of furniture and can be made from readily available materials using an available motor and gear box. A steel shaft mounted in conventional bushings in a wooden frame with an easily formed helical cam bar formed and attached to the shaft by welding while the slats 15 can be conventional heavy wooden slats. A pair of shafts can also be used driven by the same or 2 separate motors without departing from the invention. The present invention, however, is not to be construed as limited to the particular forms disclosed herein which are to be regarded as illustrative, rather than restrictive.

I claim:

1. A massage apparatus comprising in combination:

a frame;

an electric motor attached to said frame;

an elongated cam rotatably connected to said frame and rotatably connected to said electric motor for rotation thereby;

a plurality of slats movably mounted transverse to said elongated cam and adjacent thereto whereby rotation of said elongated cam will raise and lower said slats responsive to said cam;

flexible material attached to said frame and covering said slats to hold said slats adjacent to said elongated cam; and an elongated ledge attached to said frame which supports each end of each of said slats on one side, while said flexible material cover supports the slats on the other side thereof.

2. The apparatus in accordance with claim 1, in which said elongated cam is a linearly extending shaft having a bar helically wrapped therearound.

3. The apparatus in accordance with claim 2, in which said shaft is an elongated cylindrical shaft having an elongated cylindrical bar wrapped therearound to form said cam.

4. The apparatus in accordance with claim 3, in which said motor is mounted to a gear box which drives said elongated shaft.

5. The apparatus in accordance with claim 4, in which a pair of bushings is mounted in said frame and said shaft rides in said bushings.

6. The apparatus in accordance with claim 5, in which said plurality of slats is a plurality of wooden slats.

7. The apparatus in accordance with claim 6, in which said wooden slats are substantially rectangular in cross-section.

8. The apparatus in accordance with claim 7, in which said slats have padding thereagainst and said cover is mounted over said padding.

9. The apparatus in accordance with claim 8, in which said massage apparatus is mounted in the back portion of the chair and said cover material is the cover for said chair back.

10. The apparatus in accordance with claim 1, in which the plurality of slats are interconnected polymer slats.

11. A massage apparatus comprising in combination:

a frame;

an electric motor attached to said frame;

an elongated cam rotatably connected to said frame and operatively connected to said electric motor for rotation thereby, said elongated cam having a linearly extending shaft having a bar helically mounted therearound;

a plurality of slats movably mounted transverse to said elongated cam and adjacent thereto, whereby rotation of said elongated cam will raise and lower said slats responsive to said rotation of said cam; and support means attached to said frame for supporting said plurality of slats.

* * * * *